US009422856B2

(12) United States Patent
Németh et al.

(10) Patent No.: US 9,422,856 B2
(45) Date of Patent: Aug. 23, 2016

(54) VALVE DEVICE FOR CONTROLLING THE AIR INTAKE FOR A COMPRESSOR OF A VEHICLE, AND COMPRESSOR SYSTEM AND METHOD FOR CONTROLLING A COMPRESSOR SYSTEM

(71) Applicant: KNORR-BREMSE Systeme fuer Nutzfahrzeuge GmbH, Munich (DE)

(72) Inventors: Huba Németh, Budapest (HU); Laslo Menyhart, Gyal (HU)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 192 days.

(21) Appl. No.: 13/923,985

(22) Filed: Jun. 21, 2013

(65) Prior Publication Data

US 2013/0276764 A1 Oct. 24, 2013

Related U.S. Application Data

(63) Continuation of application No. PCT/EP2011/072066, filed on Dec. 7, 2011.

(30) Foreign Application Priority Data

Dec. 22, 2010 (DE) ..... 10 2010 055 692

(51) Int. Cl.
*F02B 33/44* (2006.01)
*F04B 41/06* (2006.01)
(Continued)

(52) U.S. Cl.
CPC ..... *F02B 33/44* (2013.01); *F04B 39/102* (2013.01); *F04B 39/1033* (2013.01); *F04B 41/06* (2013.01); *F04B 49/007* (2013.01); *F04D 25/04* (2013.01); *F04D 25/16* (2013.01)

(58) Field of Classification Search
CPC ..... F02B 33/44; F04B 41/06; F04B 49/007; F04B 39/102; F04B 39/1033; F04D 25/04; F04D 25/16
See application file for complete search history.

(56) References Cited

U.S. PATENT DOCUMENTS 2,350,896 A * 6/1944 Jde ..... 244/59
3,204,859 A * 9/1965 Crooks ..... 417/203
(Continued)

FOREIGN PATENT DOCUMENTS

CN 2433417 Y 6/2001
DE 24 29 976 A1 1/1976
(Continued)

OTHER PUBLICATIONS

Clippard Training—Understanding ANSI / ISO Schematic Symbols for Fluid Power Components, from www.clippard.com, last saved Sep. 7, 2015 (also included is Wayback Machine to determine date of the website).*
(Continued)

*Primary Examiner* — Mary A Davis
(74) *Attorney, Agent, or Firm* — Crowell & Moring LLP

(57) ABSTRACT

A valve device controls the air intake for a compressor of a vehicle. The valve device includes a valve housing having a first compressed air inlet for connecting to an ambient air infeed, a second compressed air inlet for connecting to a charge air infeed, through which pre-compressed air can be fed, and a compressed air outlet for connecting to the compressor. The valve device includes a first switched state in which the compressed air outlet is fluidically connected to the first compressed air inlet, and a second switched state in which the compressed air outlet is fluidically connected to the second compressed air inlet. The valve device includes a switching device capable of switching the valve device between the first switched and the second switched state.

10 Claims, 6 Drawing Sheets

(51) Int. Cl.

| | |
|---|---|
| ***F04B 39/00*** | (2006.01) |
| ***F04B 39/10*** | (2006.01) |
| ***F04D 25/04*** | (2006.01) |
| ***F04D 25/16*** | (2006.01) |
| ***F04B 49/00*** | (2006.01) |

(56) References Cited

U.S. PATENT DOCUMENTS

| | | | | |
|---|---|---|---|---|
| 3,561,484 | A | 2/1971 | Taplin | |
| 5,154,147 | A | 10/1992 | Muroki | |
| 5,906,480 | A | 5/1999 | Sabelstroem et al. | |
| 6,289,931 | B1 * | 9/2001 | Sisk et al. | 137/625.43 |
| 2008/0042095 | A1 | 2/2008 | Jabcon, Jr. | |
| 2010/0065025 | A1 * | 3/2010 | Bucknell | 123/559.1 |
| 2010/0083929 | A1 * | 4/2010 | Sakagami et al. | 123/184.56 |
| 2011/0070102 | A1 | 3/2011 | Mellar | |
| 2012/0012086 | A1 * | 1/2012 | Yoeda et al. | 123/559.1 |

FOREIGN PATENT DOCUMENTS

| | | | |
|---|---|---|---|
| DE | 203 16 356 | U1 | 1/2004 |
| DE | 10 2007 035 775 | A1 | 1/2009 |
| FR | 2278956 | A1 * | 2/1976 |
| GB | 2 119 065 | A | 11/1983 |
| JP | 48-14209 | B1 | 4/1973 |
| JP | 51-15806 | A | 2/1976 |
| JP | 58-60066 | U | 4/1983 |
| JP | 60-188274 | U | 12/1985 |
| JP | 62-66059 | U | 4/1987 |
| JP | 5-296358 | A | 11/1993 |
| JP | 9-509119 | A | 9/1997 |
| JP | 2006-90225 | A | 4/2006 |
| RU | 2 299 142 | C1 | 5/2007 |
| WO | WO 03/074911 | A2 | 9/2003 |
| WO | WO 2007/118674 | A2 | 10/2007 |
| WO | WO 2009/146866 | A1 | 12/2009 |
| WO | WO 2010113300 | A1 * | 10/2010 |

OTHER PUBLICATIONS

International Preliminary Report on Patentability (PCT/IB/373) dated Jun. 25, 2013, including Written Opinion (PCT/ISA/237) (six (6) pages).

International Search Report dated Apr. 25, 2012 including English-language translation (Four (4) pages).

Japanese Office Action issued in Japanese counterpart application No. 2013-545168 dated Oct. 5, 2015, with partial English translation (Seven (7) pages).

Russian Office Action issued in Russian counterpart application No. 2013133996/06(050847) dated Dec. 7, 2015, with partial English translation (Seven (7) pages).

* cited by examiner

VALVE DEVICE FOR CONTROLLING THE AIR INTAKE FOR A COMPRESSOR OF A VEHICLE, AND COMPRESSOR SYSTEM AND METHOD FOR CONTROLLING A COMPRESSOR SYSTEM

CROSS REFERENCE TO RELATED APPLICATIONS

This application is a continuation of PCT International Application No. PCT/EP2011/072066, filed Dec. 7, 2011, which claims priority under 35 U.S.C. §119 from German Patent Application No. DE 10 2010 055 692.0, filed Dec. 22, 2010, the entire disclosures of which are herein expressly incorporated by reference.

BACKGROUND AND SUMMARY OF THE INVENTION

The present invention relates to a valve device for controlling the air intake for a compressor of a vehicle. The invention also relates to a compressor system including a valve device of this type, and also to a method for controlling an air intake for a compressor of a compressor system of a vehicle.

In modern vehicles, in particular commercial vehicles, systems operated with compressed air are often used. Systems of this type are found, for example, in brake systems and suspension systems. To generate and prepare the compressed air, compressed air preparation systems are used, which for example generate, filter and store compressed air and forward it onto the corresponding systems. Compressed air preparation systems of this type are used, for example, in lorries, rail vehicles and tractors and include a compressor and associated components of a compressor system in order to pressurize air. In order to achieve an efficient utilization of energy from a central drive device, such as an engine, turbochargers are often used in vehicles of this type. Energy can be drawn, for example, from an exhaust gas flow via a turbocharger. It is already known to use a turbocharger to precompress air before it is fed to the compressor of the compressed air preparation device or to the compressor system in order to increase the air volume flowing from the compressor per unit of time. In this context, it is known from document WO 2009/146866 A1 to supply air precompressed by a turbocharger or ambient air to the compressor, said air being fed to the compressor in a manner in which the turbocharger is bypassed.

The object of the present invention is to provide a possibility that is as reliable, simple and cost-effective as possible for selectively feeding ambient air or precompressed air to a compressor of a vehicle.

This and other objects are achieved in accordance with the invention by a valve device for controlling the air intake for a compressor of a vehicle, wherein the valve device comprises a valve housing, which comprises a first compressed air inlet for connection to an ambient air feed, a second compressed air inlet for connection to a charge air feed, via which precompressed air can be fed, and a compressed air outlet for connection to the compressor. The valve device has a first switched state, in which the compressed air outlet is fluidically connected to the first compressed inlet, and has a second switched state, in which the compressed air outlet is fluidically connected to the second compressed air inlet. The valve device further comprises a switching device, which is capable of switching the valve device between the first switched state and the second switched state. The valve device can thus be switched in a simple manner between an intake of ambient air and an intake of charge air to the compressor.

The valve device can be provided, in particular, for use in a compressor system of a vehicle. Besides two compressed air inlets, the valve device may, in particular, have only one outlet for connection to the compressor. The switching device or the valve device can be electrically or pneumatically actuated in order to switch between switched states. It is contemplated for a sensor device to be connectable or connected in the region of the compressed air outlet, in the compressed air outlet, or downstream of the compressed air outlet. In particular, the sensor device may include a pressure sensor and/or a flow sensor. It is expedient if the sensor device or its sensors are connected to an electronic control device. It is also contemplated to form or to consider the sensor device as part of the valve device and/or as part of a compressor system. The sensor device can be formed or connected to determine the switched state of the valve device and/or to detect and to transmit data for detection and/or control of the switched state.

The valve device may include an electronic control device and/or may be connected or connectable to an electronic control device. A control device of this type can be formed, in particular, to control and/or switch the valve device or the switching device between different switched states. The electronic control device of the valve device, for communication purposes, may be connected or connectable to at least one further, possibly superordinate, control device of the vehicle. In particular, the switching device can be formed for control by way of the control device. It is expedient if a sensor device, for signal transmission, is connected to a corresponding control device.

The valve device can be formed in such a way that, in each switched state, it provides a fluidic connection of its single outlet, specifically the compressed air outlet, to at least one of the compressed air inlets. In particular, it may be that the fluid line between the first compressed air inlet and the compressed air outlet and the fluid line between the second compressed air inlet and the compressed air outlet are not shut off simultaneously in any switched state of the valve device.

As a result of the switching device, a fluid line between the second compressed air inlet and the compressed air outlet can be closed in the first switched state and/or a fluid line between the first compressed air inlet and the compressed air outlet can be closed in the second switched state. In the first switched state, only compressed air is therefore forwarded via the first compressed air inlet to the compressed air outlet and ultimately to the compressor, whereas an intake of compressed air via the second compressed air inlet is prevented. Conversely, in the second switched state, only an intake of compressed air via the second compressed air inlet is possible.

The valve device may have at least one third switched state, in which the first compressed air inlet and the second compressed air inlet are fluidically connected to the compressed air outlet. Fed air can thus be mixed. If, for example, compressed air having a pressure critical for the compressor is fed via the charge air feed, the pressure can thus be lowered by an intake of ambient air or by releasing precompressed air via the first compressed air inlet. On the one hand, the compressor can thus be preserved. On the other hand, it is not necessary to intervene in the turbocharger system in order to reduce the charge air pressure, which reduces the circuit complexity for the vehicle.

In particular, the valve device may have a series of different switched states, in which the first compressed air inlet and the second compressed air inlet are fluidically connected to the compressed air outlet. The switched states may differ with regard to the cross-sections of the first compressed air inlet and of the second compressed air inlet released in the valve device and/or with regard to the ratio of the released cross-sections. Different mixing ratios can thus be adjusted. It may be expedient if the switched state of the valve device between the first switched state and the second switched state can be adjusted substantially continuously. The valve device may therefore have further intermediate switched states between the first switched state and the second switched state. Here, it may be expedient if a sensor for detecting the pressure level of the fed air is arranged in the ambient air feed and/or in the charge air feed. The sensors can be connected directly or indirectly via further electronic components to the electronic controller of the switching device or of the valve device. An electronic controller may be embodied in such a way that it sets a switched state of the valve device, in which air guided via the compressed air outlet to the compressor does not exceed a predetermined pressure threshold value. A control process of this type can be implemented, for example, based on the sensor signals and can be achieved by switching between switched states.

The switching device of the valve device may have a piston, which is movable between a first position corresponding to the first switched state, in which it releases a fluidic connection between the first compressed air inlet and the compressed air outlet, and a second position corresponding to the second switched state, in which it releases a fluidic connection between the second compressed air inlet and the compressed air outlet. The piston can be received within the valve housing, in particular in a channel for guiding the piston. It is contemplated for the piston to have a seal, which for example to provide a seal between the piston and the elements of the valve housing or of the valve device in which it moves, for example the channel. It is thus easy to switch in particular between the first switched state and the second switched state.

The valve housing may have a first valve seat, which is assigned to the first compressed air inlet, and a second valve seat, which is assigned to the second compressed air inlet. It may be possible to bring a piston of the switching device controllably into bearing contact with the first valve seat and controllably into bearing contact with the second valve seat. In the first switched state, the piston is in bearing contact with the second valve seat and closes the fluid line between the second compressed air inlet and the compressed air outlet. In the second switched state, the piston is in bearing contact with the first valve seat and closes the fluid line between the first compressed air inlet and the compressed air outlet. This construction provides an accurately defined movement space for the piston. In the region of at least one valve seat, a sensor, for example a contact sensor, may be provided for example for localization of the piston. Such a sensor can be connected to a control device. A valve seat can be formed, for example, as an opening assigning a constriction in a corresponding compressed air inlet or a line portion. In particular, the piston can be movable back and forth between a position in which it is in bearing contact with the first valve seat and a position in which it is in bearing contact with the second valve seat. Here, it is contemplated for intermediate switched states to be established.

The switching device may have a switching disk, which is rotatable between a first position corresponding to the first switched state, in which it releases a fluidic connection between the first compressed air inlet and the compressed air outlet, and a second position corresponding to the second switched state, in which it releases a fluidic connection between the second compressed air inlet and the compressed air outlet. This is a further possibility for providing a reliable switching device that is to be switched easily.

In a further development, the switching device also includes an outlet disk with an outlet opening, via which a fluidic connection from the switching disk to the compressed air outlet can be produced or established, and also an inlet disk with a first inlet opening, via which a fluidic connection from the first compressed air inlet to the switching disk can be produced or established, and with a second inlet opening, via which a fluidic connection from the second compressed air inlet to the switching disk can be produced or established. The switching disk is arranged rotatably between the outlet disk and the inlet disk and forms a switching opening. Furthermore, the switching disk may be rotatable between a first position, in which a fluidic connection exists between the outlet opening and the first inlet opening via the switching opening in the switching disk, and a second position, in which a fluidic connection exists between the outlet opening and the second inlet opening via the switching opening. A simple switching device can thus be produced, with which the rotation of the switching disk is hardly stressed by compressed air from one of the compressed air inlets, since the switching disk is rotatable orthogonal to the airflow. The first position corresponds to the first switched position, and the second position corresponds to the second switched position. The switching disk may cover the second inlet opening in the first position and may cover the first inlet opening in the second position in such a way that it shuts off a fluid line through the corresponding openings. In this variant also, intermediate switched states are of course possible, in which a defined mixing of compressed air fed from both compressed air inlets is possible, as mentioned above. The outlet disk and/or the inlet disk can be mounted within the valve housing such that they are stationary with respect to the housing.

It is contemplated for the switching device to include an electric motor as an actuation device for switching between switched states. The switching device may also be connected to a separate actuation device, such as a motor of this type. An electromagnet and/or a spring device can also be used as an actuation device. The actuation device can be actuated by one of the above-described control devices.

The valve device can be formed in particular as a 3/2 valve. No unnecessary inlets and outlets are thus provided, which facilitates construction and control.

The present invention also relates to a compressor system comprising a valve device for controlling an air intake for a compressor as described above. Depending on the design of the valve device, advantages substantially identical to those already discussed are provided for the compressor system. The compressor system may include an ambient air feed and a charge air feed.

The compressor system may include a shut-off valve, which is connected between the compressed air outlet of the valve device and the compressor, and which is capable of shutting off or releasing the intake of compressed air from the valve device to the compressor. In particular, the shut-off valve may be capable of shutting off an intake of compressed air between the compressed air outlet and the compressor in a shut-off position and of enabling an intake of compressed air between the compressed air outlet and the compressor in a conducting position. An undesired intake of compressed air to the compressor can thus be prevented in a simple manner, for example when the compressor is operated in an idle phase. The compressor may alternatively or additionally also be coupled to a compressor coupling, via which it can be uncoupled from a drive.

The compressor system may expediently include an electronic control device, which is suitable for controlling the valve device. The control device can be connected directly to the valve device or to the switching device. It is contemplated for the control device of the compressor system to be connected to a control device of the valve device. The compressor system may include a sensor device connected between the compressed air outlet of the valve device and the compressor. The sensor device may in particular comprise a pressure sensor and/or a flow sensor. The sensor device or its sensors can be connected to an electronic control device. It is contemplated for the sensor device to be formed or connected to determine the switched state of the valve device and/or, for detection and/or control of the switched state, to detect data and to transmit the data to a control device, which may be a control device of the compressor system and/or part of an on-board electronic system. A control device of this type may, in particular, be formed to control and/or switch the valve device or the switching device between different switched states. It is expedient if the sensor device, for signal transmission, is connected to a corresponding control device. The control device may be connected to a CAN bus of the vehicle.

The invention also relates to a method for controlling an air intake for a compressor of a compressor system, as is described herein, wherein, for the air intake, the compressor is connected to the compressed air outlet of the valve device. The method includes the following step of controlling the valve device in such a way that the valve device switches between two switched states. The control can be implemented based on sensor signals of the sensor devices or sensors described herein. During the control process, vehicle parameters such as the vehicle speed, engine parameters such as the engine speed, and/or compressor parameters such as the compressor speed can be taken into consideration.

In accordance with a further development, the valve device is controlled such that it switches between the first switched state and the second switched state.

The valve device may also be controlled such that it is switched to or from a third switched state, in which the first compressed air inlet and the second compressed air inlet are fluidically connected to the compressed air outlet.

Within the scope of this description, a vehicle may be any type of motor vehicle. In particular, a vehicle may be a commercial vehicle, a mobile construction machine, a rail vehicle, a tractor or a lorry. A compressor system may comprise a compressor. A compressor or a compressor system may comprise a compressor coupling. A compressor system may comprise components for compressed air intake, lines, valves, compressed air connections and/or similar components. Components for controlling compressed airflows, for controlling the compressor or a compressor coupling may also be considered as parts of a compressor system. A compressed air preparation device comprising an air drier, a multi-circuit protection valve and further components can be considered a compressor system or may comprise a compressor system. A control process can be carried out electronically, electrically or pneumatically. A combination of electronic and pneumatic control may also be provided. A compressor system may, in particular, comprise one or more electronic control devices.

An electronic control device may be provided for example to control the compressor and/or the compressor coupling and/or a valve device, in particular to control one of the above-described valve devices, and/or may be accordingly connected. A control device may carry out a control process based on signals from one or more pressure sensors. It is particularly expedient if the control process is carried out based on signals transmitted from the sensor device arranged downstream of the valve device and/or is based on signals from the charge air feed and/or the ambient air feed. A control process may be carried out under consideration of vehicle parameters such as a vehicle speed, engine parameters such as an engine speed, and/or compressor parameters such as a compressor speed. Here, it may be expedient to transmit corresponding parameters via an on-board electronic system, for example a CAN bus, to the control device, which carries out the control process.

A charge air feed is used for the intake of precompressed air for a compressor. The air can be precompressed by a turbocharger or by another suitable device. An ambient air feed is used for the intake of ambient air, which is not precompressed. The ambient air may therefore be at atmospheric pressure. The shut-off of a fluid line can be interpreted as the closing of any direct or indirect fluidic connection. Two components, between which a fluid line is shut off, expediently cannot exchange any fluid, in particular any compressed air. A fluid, in particular air or compressed air, can flow between fluidically connected devices, such as a compressed air inlet and a compressed air outlet.

One or more openings and/or line portions and/or pressure chambers can be assigned to a compressed air inlet or compressed air outlet of a valve housing. An inlet or outlet can therefore be understood as an inlet region or outlet region, provided compressed air flows in substantially just at one opening point and flows out again from the region substantially only at one opening point.

Other objects, advantages and novel features of the present invention will become apparent from the following detailed description of one or more preferred embodiments when considered in conjunction with the accompanying drawings.

DETAILED DESCRIPTION OF THE DRAWINGS

Figure 1:
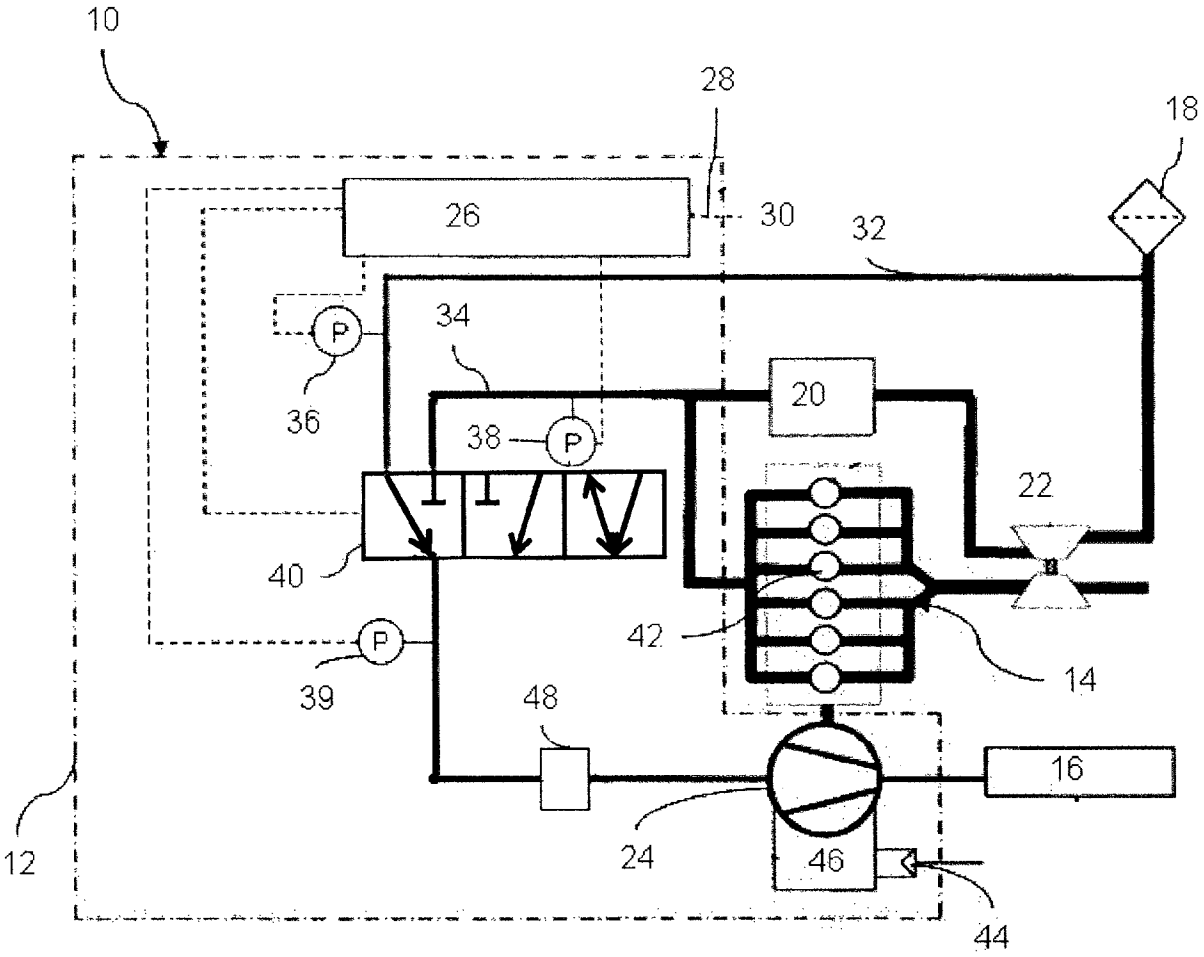
FIG. 1 is a schematic illustration of a vehicle comprising a compressor system.

In the following description of the figures, like reference signs denote like or functionally similar components. In FIG. 1, pneumatic lines are illustrated as solid lines, whereas electrical lines and connections are illustrated in a dashed manner.

FIG. 1 shows a schematically illustrated commercial vehicle 10. Besides a drive motor 14 and a compressor system 12, the illustrated commercial vehicle 10 includes a compressed air preparation system with consumers 16, an air filter 18, a charge air cooler 20, and a turbocharger 22. Besides a compressor 24, which may be a single-cylinder or a two-cylinder compressor, the compressor system 12 itself includes an electronic control device 26 with a connection 28 to a CAN bus 30. An ambient air feed 32 and a charge air feed 34 are provided. A first pressure sensor 36 is provided in the ambient air feed 32, and a second pressure sensor 38 is provided in the charge air feed 34. Instead of the pressure sensors 36, 38, flow sensors or other suitable sensor devices, for example comprising a pressure sensor and a flow sensor, can be provided. The ambient air feed 32 guides air from the ambient environment directly behind the air filter 18 to an air intake valve device 40. The charge air feed guides precompressed air, also referred to as charge air, which is precompressed by the turbocharger 22 and then cooled in the charge air cooler 20, likewise to the air intake valve device 40. The air intake valve device 40 is connected to the compressor 24 in order to feed thereto air for compression. A sensor device 39 is connected between the compressor 24 and an outlet, connected thereto, of the air intake valve device 40. The sensor device 39 includes a pressure sensor and a flow sensor. The valve device 40 preferably comprises just one single compressed air outlet for connection to the compressor 24 or for the intake of air to the compressor 24.

Depending on the switched state of the valve device 40, the compressor 24 draws in air, which has already been precompressed by the turbocharger 22, via the charge air feed 34 or draws in ambient air, which is not precompressed, via the ambient air feed 32. If the valve device 40 is in its illustrated first switched state, the compressor 24 thus draws in ambient air via the air filter 18 and the ambient air feed 32. In the second switched state (not illustrated), the compressor 24 draws in air, which has already been precompressed by the turbocharger 22, via the air filter 18, the turbocharger 22, the charge air cooler 20 and the charge air feed 34. Due to the increased charge pressure compared to the ambient pressure, the air volume conveyed by the compressor 24 per unit of time increases here with constant rotational speed of the compressor 24.

The turbocharger 22 is driven by the exhaust gases of the drive motor 14, wherein the primary task of the turbocharger 22 is to be considered a charging of the drive motor 14, that is to say that six illustrated cylinders 42 of the drive motor 14 are operated with a greater amount of combustion air.

The compressor 24 is driven by the drive motor 14 in a manner known by a person skilled in the art. For example, the compressor 24 can be driven by the drive motor 14 via a geared drive. The compressed air conveyed by the compressor 24 is fed to the compressed air preparation system with consumers 16. The compressed air preparation system with consumers 16, in particular, includes a compressed air preparation system known to a person skilled in the art and also a plurality of consumer circuits, which for example are protected from one another by means of a multi-circuit protection valve and which are connected to the individual consumers. The compressor 24 also has a dead space 46, measuring approximately 10 ccm per cylinder and connectable by a valve device 44 in order to attenuate pressure peaks during the compressed air conveyance. A dead space 46 is generally understood to be any space connected to a piston chamber of the compressor, said space remaining empty at the end of a compression stroke of the compressor. The connection of a dead space 46 therefore lowers the possible maximum compression of the compressor and therefore lowers the pressure peaks during a compression stroke.

A shut-off valve 48 can be arranged between the compressor 24 and the air intake valve device 40, and an air intake from the air intake valve device 40 to the compressor 24 can be shut off or opened via said shut-off valve. The compressor 24 then, when the shut-off valve is closed, cannot draw in any air and consequently also can no longer convey compressed air. It is known that, in this state, oil, which is used conventionally for lubrication of the compressor 24, is drawn into the compression chamber by the negative pressure produced during an expansion stroke of the compressor 24 and is ejected during the next compression stroke of the compressor 24 in the direction of the connected compressed air preparation system with consumers 16. In order to prevent this, it is contemplated for the shut-off valve 48 not to be completely sealed, but to have a defined residual leak in order to limit the intake negative pressure of the compressor 24. The oil ejection of the compressor 24 is thus reduced. The shut-off of the air intake to the compressor 24 by use of the shut-off valve is a simple possibility for transferring the compressor 24 into an energy-saving operating mode. Alternatively or additionally, the compressor 24 can be coupled to its drive via a coupling apparatus. By releasing the coupling, the compressor 24 can be transferred into an energy-saving operating mode.

If the charge pressure provided by the turbocharger 22 is below an adjustable charge pressure threshold, the air intake valve device 40 is in its second switched state (not illustrated). The compressor 24 then receives air, which has already been precompressed, via the charge air feed 34. The compressor 24 is optimized for the intake of air that has not been precompressed, as a result of which low charge pressures considerably increase the air volume conveyed therefrom. Up to a charge pressure of approximately 0.6 bar, the compressor 24 optimized for the intake of air that has not been precompressed can also without difficulty convey air that has already been precompressed. If the charge pressure provided by the turbocharger 22 exceeds this first limit, which is also referred to as a dead space charge pressure threshold, the dead space 46 associated with the compressor 24 is thus connected via the valve device 44 in order to lower the conveying pressures occurring during the conveyance of the air that has already been compressed. If the charge pressure provided by the turbocharger 22 rises further and ultimately exceeds a further limit referred to as a charge pressure threshold, the conveying pressures occurring can thus damage the compressor 24 in spite of the dead space 46. If the charge pressure threshold is exceeded, the air intake valve device 40 is therefore transferred into its illustrated first switched state. The dead space 46 associated with the compressor 24 can be closed again by actuation of the valve device 44. The compressor 24 optimized for the intake of air that has not been precompressed now, via the ambient air feed 32, draws in air that has not been precompressed. The connection of the dead space 46 can also otherwise be used to reduce the conveyed air volume or to save energy if a large quantity of air is not required. The valve device 44 can be controlled or actuated for example via the control device 26.

The air intake valve device 40 is an electrically or pneumatically actuatable valve device, which in particular releases a maximum flow cross section of the air feeds 32, 34 depending on its switched state. The air intake valve device 40 can be connected to the electronic control device 26, which can be formed to control the valve device in particular based on signals of the sensor device 39 and/or of the sensors 36, 38. Control can also occur directly via one or more of the sensors 36, 38, 39, which then accordingly are connected to the air intake valve device 40, wherein no further data are then required by an engine control device in order to switch the valve device 40. The air intake valve device 40 can be controlled via the electronic control device 26 in accordance with the engine speed and/or the compressor speed and/or further engine parameters and/or vehicle parameters. The engine speed and other parameters can be read out preferably from an engine control device and/or another control device. In this case, the characteristic map of the engine turbocharger can be presumed as known. Corresponding data can be transmitted via the CAN bus 30.

FIGS. 2 to 5 are schematic illustrations of different valve devices, which can each be used as an air intake valve device 40 for a compressor system. Each of these valve devices has a valve housing 100. A first compressed air inlet 102, a second compressed air inlet 104 and a single compressed air outlet 106 are provided on the valve housing. Expediently, the first compressed air inlet 102 is provided for connection to an ambient air feed, and the second compressed air inlet 104 is provided for connection to a charge air feed. The compressed air outlet 106 is provided for the intake of compressed air from at least one of the compressed air inlets 102, 104 to a compressor.

The valve devices each have at least one first switched state, in which the compressed air outlet 106 is fluidically connected to the first compressed air inlet 102, and a second switched state, in which the compressed air outlet 106 is fluidically connected to the second compressed air inlet 104. A switching device is also provided in order to switch the valve device between different switched states. The switching device in each case comprises an actuation device 108, which is controllable via an electrical control line 110. The control line 110 can be connected for example to a control device 26 and/or to one or more sensor devices. The actuation device 108 may have a shaft or a rod 109 for power transmission. It is contemplated for the actuation device 108 to be formed as an electric motor or an electromagnet. The actuation device 108 can be controllable in such a way that it sets a multiplicity of switched states of the valve device. In particular, intermediate switched states, in which both the first compressed air inlet 102 and also the second compressed air inlet 104 are simultaneously connected to the compressed air outlet 106, are thus possible. In these intermediate switched states, there is thus a different mixture of the fed air, or it is possible for compressed air coming from the charge air feed 34 to escape via the ambient air feed 32 in varying extents due to differently set flow cross sections. The intermediate switched states can be controlled continuously.

Figure 2:
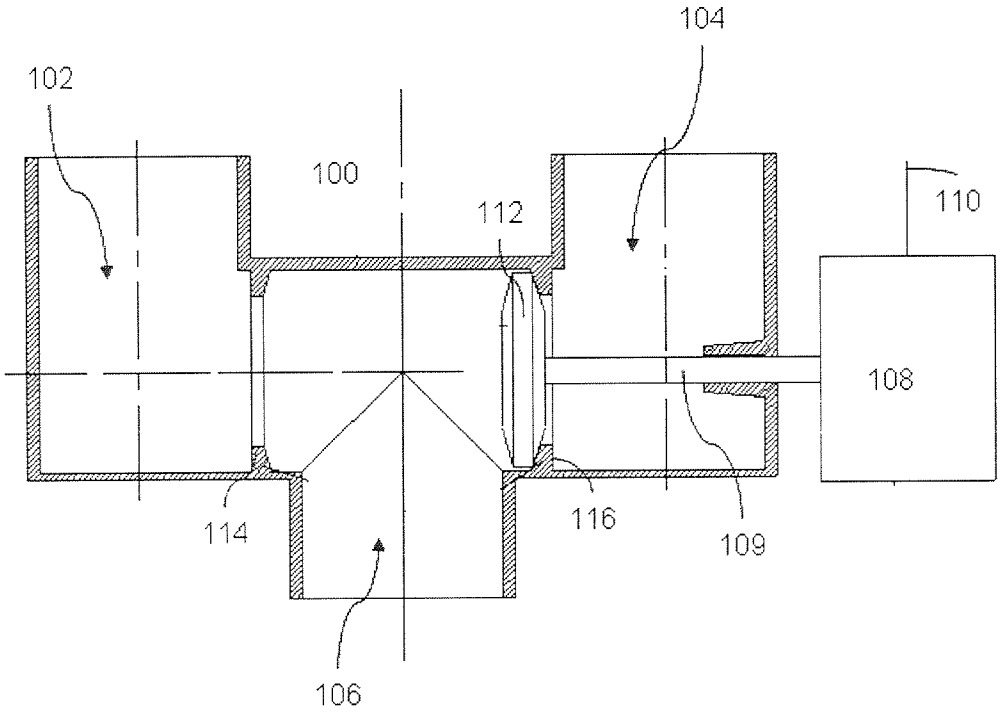
FIG. 2 is a schematic illustration of a variant of a valve device.

In the case of the valve device shown in FIG. 2, the switching device includes a piston 112, which is movable within the housing 100 by way of the actuation device 108. In the valve housing 100, a first valve seat 114 is provided and is assigned to the first compressed air inlet 102. A second valve seat 116 is assigned to the second compressed air inlet 104. The valve seats 114, 116 form a respective stop for the piston 112, of which the movement is therefore limited to the region between the valve seats 114, 116. If the piston 112 bears against the first valve seat 114, it closes the fluid connection between the compressed air outlet 106 and the first compressed air inlet 102. A fluidic connection is present between the second compressed air inlet 104 and the compressed air outlet 106, and air can thus flow there. This position of the piston corresponds to the second switched state of the valve device. If, on the other hand, the piston 112 bears against the second valve seat 116, as is shown in FIG. 2, it closes the fluid connection between the compressed air outlet 106 and the second compressed air inlet 104. A fluidic connection is present between the first compressed air inlet 102 and the compressed air outlet 106, and air can thus flow there. This position of the piston 112 corresponds to the first switched state of the valve device. Intermediate switched states can be set by positioning the piston in a position between the valve seats 114, 116.

Figure 3:
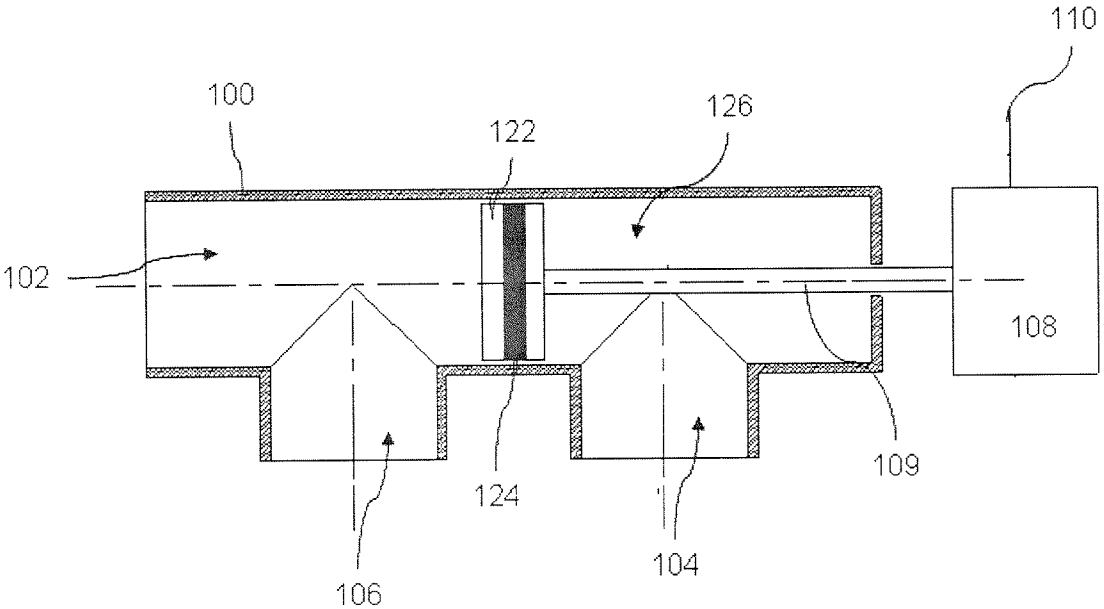
FIG. 3 is a schematic illustration of a further variant of a valve device.

FIG. 3 shows a variant of a valve device, in which the switching device includes a piston 122, which is movable by way of the actuation device 108. The piston 122 comprises a seal 124, which is used to provide a seal with respect to the valve housing 100. In this variant, no valve seats limiting a movement of the piston 122 are provided. Rather, the piston 122 is received in a channel 126 and can be moved therein. At one end of the channel 126, the piston can penetrate at least partially into the first compressed air inlet 102 or into an assigned line in order to block a fluid connection between the first compressed air inlet 102 and the compressed air outlet 106. Air can flow between the second compressed air inlet 104 and the compressed air outlet 106. This position corresponds to the second switched state. The piston 122, as shown in FIG. 3, can also be moved into a position between the second compressed air inlet 104 and the compressed air outlet 106 in such a way that it blocks a fluid connection between the second compressed air inlet 104 and the compressed air outlet 106. Air can flow between the first compressed air inlet 102 and the compressed air outlet 106. This position corresponds to the first switched state. In this variant, the compressed air outlet 106 and the second compressed air inlet 104 divert from the channel 126 at right angles to the direction of movement of the piston 122, whereas the first compressed air inlet 102 can receive the piston 122 in the direction of movement. The channel 126 in the housing 100 has a cavity, in which the piston 122 can be received in order to completely release both compressed air inlets 102, 104. The maximum cross section can thus be released for both air feeds.

Figures 4A, 4B:
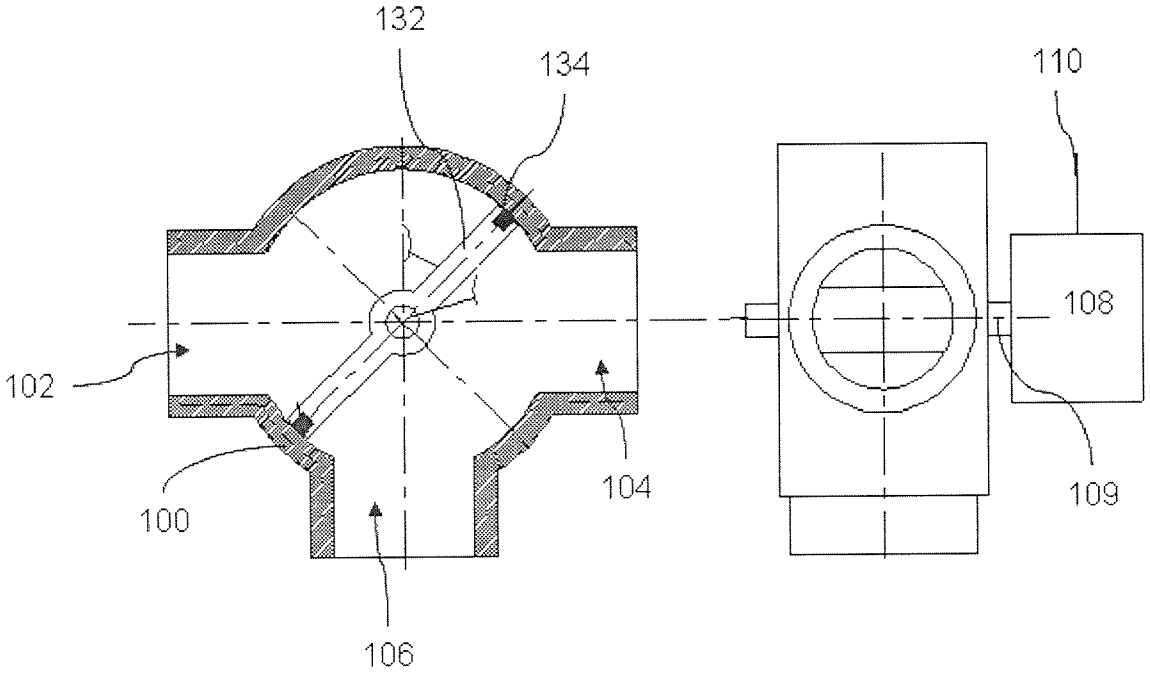
FIGS. 4*a* and 4*b* show different schematic views of yet a further variant of a valve device.

FIGS. 4*a* and 4*b* show different sectional views of a further variant of a valve device. In this example, the switching device comprises a switching disk 132 that is rotatable by way of an actuation device 108. The switching disk 132 is mounted rotatably on a shaft 109 of the actuation device 108 and has a seal 134. The valve housing 100 is formed in such a way that the switching disk 132 can rotate within the housing 100 in such a way that there is sealing contact between the housing wall and seal 134 of the switching disk 132, at least in certain positions. In FIG. 4*a*, a corresponding position is shown in which the switching disk 132 closes a fluid connection between the first compressed air inlet 102 and the compressed air outlet 106. A fluidic connection is present between the second compressed air inlet 104 and the compressed air outlet 106. FIG. 4*a* therefore shows the second switched state. By rotating the switching disk 132, the switched state can be changed. It goes without saying that intermediate switched states can be adopted and are defined by a suitable rotational position of the switching disk 132. FIG. 4*b* shows a side view, in which the actuation device 108 and the shaft 109 can be seen.

Figures 5A, 5B, 5C, 5D:
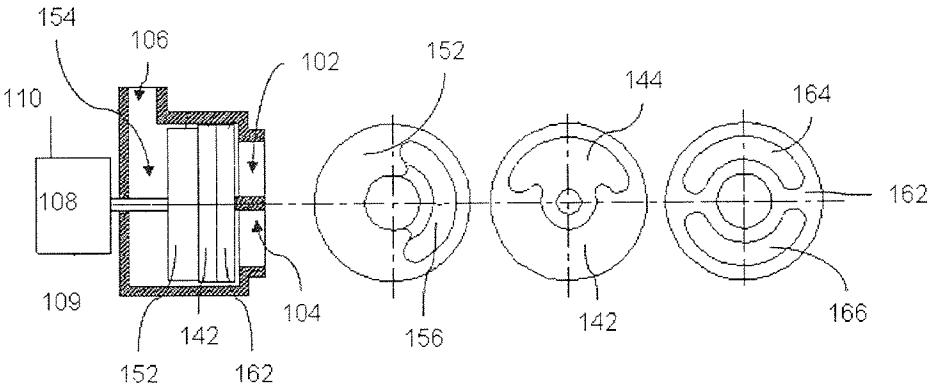
FIGS. 5*a* to 5*d* show different schematic views of yet a further variant of a valve device.

FIGS. 5*a* to 5*d* show a further variant of the valve device, in which the switching device comprises a switching disk 142 with a slitted opening 144, which is shown in FIG. 5*c*. The switching disk 142 is arranged rotatably on the shaft 109 of the actuation device 108. The switching device further comprises an outlet disk 152 mounted in the valve housing 100 and an inlet disk 162 mounted in the valve housing 100. The switching disk 142 is arranged between the inlet disk 162 and the outlet disk 152 and is rotatable relative thereto. A first flat side of the inlet disk 162 and a first flat side of the outlet disk 152 each face a flat side of the switching disk 142 and expediently bear thereagainst in an airtight manner. The second flat face of the outlet disk 152 faces a pressure chamber 154 connected to the compressed air outlet 106. The outlet disk 152 comprises an opening slit 156, which can be seen in FIG. 5*b* and by which a fluid connection from the switching disk 142 to the compressed air outlet 106 can be produced. As can be seen in FIG. 5*d*, the inlet disk 162 comprises a first inlet slit 164, via which a fluid connection to the first compressed inlet 102 can be produced. The inlet disk 162 further comprises a second inlet slit 166, via which a fluid connection to the second compressed air inlet 104 can be produced. The disks additionally have structures making it possible for the shaft 109 to be received in such a way that the switching disk 142 can rotate between the two other disks. By rotating the switching disk 142, the slitted opening 144 therein is also rotated. The openings of the switching disk 142 and the inlet disk 162 are dimensioned in such a way that the switching disk completely covers the second inlet slit 166 in the inlet disk 162, at least in a first position, and therefore blocks the fluid connection to the second compressed air inlet 104 via the inlet disk 162. In this position, the slitted opening 144 in the switching disk 142 and the first inlet slit 164 overlie one another in such a way that the opening slit 156 in the outlet disk 152, the opening 144 in the switching disk 142, and the opening in the first inlet slit 164 overlie one another at least in part. Compressed air can thus flow from the first compressed air inlet 102 to the compressed air outlet 106 through these openings or slits, whereas a fluid connection between the second compressed air inlet 104 and the compressed air outlet 106 is blocked. This corresponds to the first switched state. Similarly, the switching disk 142 can be rotated in such a way that the first inlet slit 164 is covered by the switching disk 142, and a fluidic connection is produced between the compressed air outlet 106 and the second compressed air inlet 104 via the openings 144, 156 and 166. This position of the switching disk 142 corresponds to the second switched state. By rotating the switching disk 142 into a position in which the slitted opening 144 partially overlies the first inlet opening 164 and the second inlet opening 166 and also the opening 156 in the outlet disk 152, intermediate switched states can be set, in which both compressed air inlets are fluidically connected to the compressed air outlet 106.

The inlet disk 162, the outlet disk 152 and/or the switching disk 142 can consist of ceramic material. It is also contemplated for sealing devices for sealing between the disks or between the outlet disk 152 and the compressed air outlet 106 and/or between the inlet disk and the compressed air inlets to be provided in order to prevent compressed air from flowing undesirably past the openings in the disks.

Figure 6:
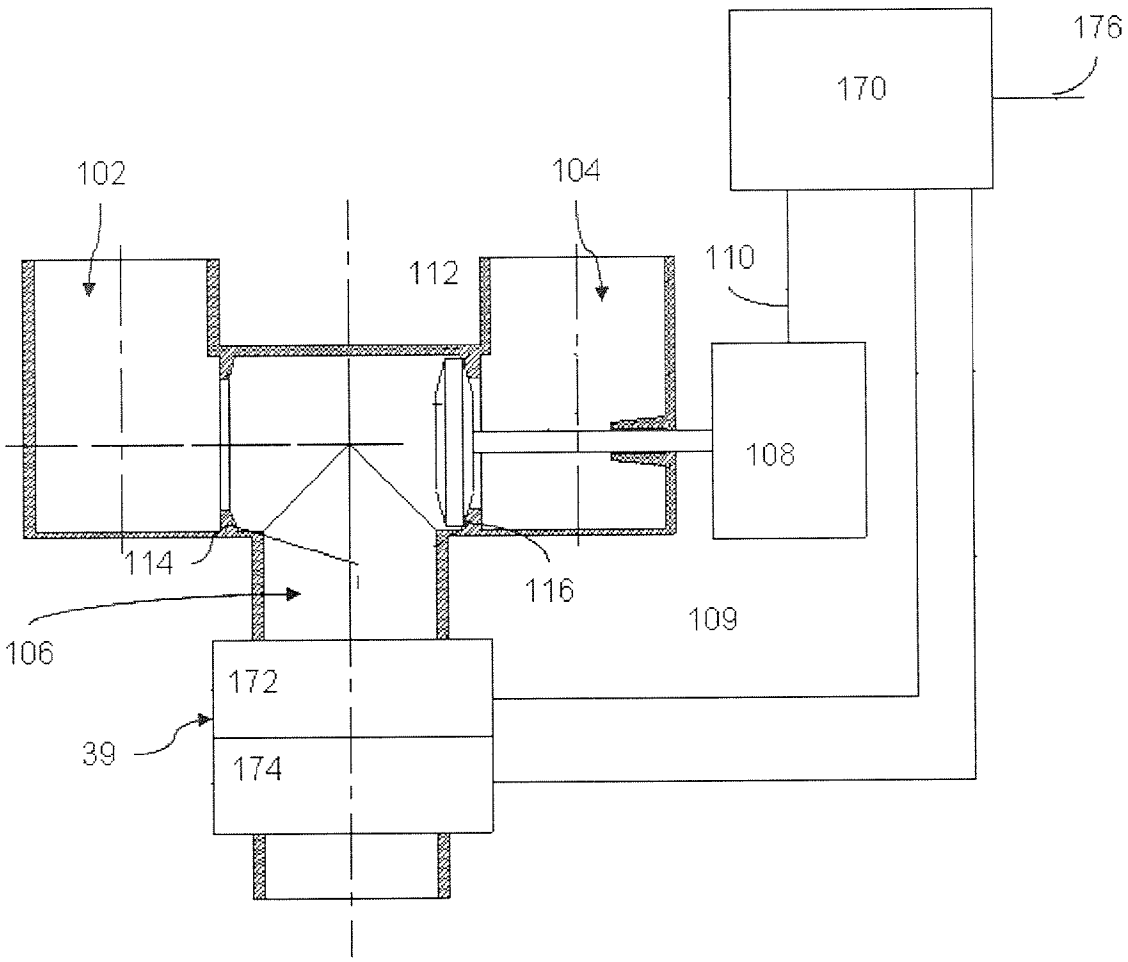
FIG. 6 is a schematic illustration of a valve device with further components.

FIG. 6 is a schematic partial view of a valve device 40 with further components. In this example, a valve device as shown in FIG. 2 can be seen. It goes without saying that any other of the above-described valve devices can be used in conjunction with FIG. 6. The actuation device 108 of the valve device 40 is connected via a control line 110 to an electronic control device 170, which can be an electronic control unit 26 as described with reference to FIG. 1. It is also contemplated for the control device 170 to be an independent control device, which for example can communicate with a control unit 26 of a compressor system or with an on-board computer system of the vehicle.

A sensor device 39 is provided downstream of the compressed air outlet 106 of the valve device 40. The sensor device 39 in this example comprises a pressure sensor 172 and a flow sensor 174. It is also contemplated for the sensor device 39 to have only one of the two sensors 172, 174 or to also have additional sensors. The sensor device 39 or the sensors 172, 174 are connected to the control device 170 for the purpose of signal transmission. The control device 170 is also connected via a signal connection 176 to one or more components, such as a control unit of the compressor unit or further devices of the on-board electronic system, for example via a CAN bus. Based on the signals of the sensor device 39 and/or signals provided by the signal line 176, which for example may represent engine parameters such as engine speed, compressor parameters such as compressor speed, or further vehicle parameters such as vehicle speed, the position of the valve device 40 or its switched state can be determined and controlled. The control process can be carried out, for example, by the control device 170.

LIST OF REFERENCE SIGNS

10 commercial vehicle
12 compressor system
14 engine
16 compressed air preparation system with consumers
18 air filter
20 charge air cooler
22 turbocharger
24 compressor
26 control device
28 connection
30 CAN bus
32 ambient air feed
34 charge air feed
36 pressure sensor
38 pressure sensor
39 sensor device
40 air intake valve device
42 engine cylinder
44 valve device
46 dead space
48 shut-off valve
100 valve housing
102 compressed air inlet
104 compressed air inlet
106 compressed air outlet
108 actuation device
109 shaft/rod
110 control line
112 piston
114 valve seat
116 valve seat
122 piston
124 seal
126 channel
132 switching disk
134 seal
142 switching disk
144 opening
152 outlet disk
154 pressure chamber
156 opening slit
162 inlet disk
164 inlet slit
166 inlet slit
170 control device
172 pressure sensor
174 flow sensor The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An engine system of a vehicle, comprising:

a compressor of the vehicle;

a valve device for controlling air intake for the compressor of the vehicle, wherein the valve device comprises:

a valve housing, the valve housing comprising:

a first compressed air inlet for connection to an ambient air feed;

a second compressed air inlet for connection to a charge air feed, via which precompressed air from a turbocharger is feedable;

a compressed air outlet for connection to the compressor;

wherein the valve device has a first switched state, in which the compressed air outlet is fluidically connected to the first compressed air inlet, the valve device has a second switched state, in which the compressed air outlet is fluidically connected to the second compressed air inlet, the valve device has a third switched state, in which the first compressed air inlet and the second compressed air inlet are fluidically connected to the compressed air outlet, and the valve device further comprises a switching device that switches the valve device between the first switched state, the second switched state, and the third switched state, wherein the compressed air outlet of the valve device is connected or connectable to the compressor for the intake of compressed air, the first compressed air inlet of the valve device is connected or connectable to the ambient air feed, and the second compressed air inlet is connected or connectable to the charge air feed for feeding precompressed air from the turbocharger.

2. The engine system as claimed in claim 1, wherein the switching device comprises a piston, which is movable between a first position corresponding to the first switched state, in which it releases a fluidic connection between the first compressed air inlet and the compressed air outlet, and a second position corresponding to the second switched state, in which it releases a fluidic connection between the second compressed air inlet and the compressed air outlet.

3. The engine system as claimed in claim 1, wherein the valve housing comprises:

a first valve seat, which is assigned to the first compressed air inlet, and a second valve seat, which is assigned to the second compressed air inlet, and further wherein, the switching device comprises:

a piston, which can be brought controllably into bearing contact with the first valve seat and can be brought controllably into bearing contact with the second valve seat, wherein, in the first switched state, the piston is in bearing contact with the second valve seat and closes a fluid line between the second compressed air inlet and the compressed air outlet, and, in the second switched state, the piston is in bearing contact with the first valve seat and closes a fluid line between the first compressed air inlet and the compressed air outlet.

4. The engine system as claimed in claim 1, wherein the switching device comprises a switching disk, which is rotatable between a first position corresponding to the first switched state, in which it releases a fluidic connection between the first compressed air inlet and the compressed air outlet, and a second position corresponding to the second switched state, in which it releases a fluidic connection between the second compressed air inlet and the compressed air outlet.

5. The engine system as claimed in claim 4, wherein the switching device further comprises:

an outlet disk with an outlet opening, via which a fluidic connection from the switching disk to the compressed air outlet can be produced or established;

an inlet disk with a first inlet opening, via which a fluidic connection from the first compressed air inlet to the switching disk can be produced or established, and with a second inlet opening, via which a fluidic connection from the second compressed air inlet to the switching disk can be produced or established; wherein the switching disk is arranged rotatably between the outlet disk and the inlet disk and comprises a switching opening;

and wherein the switching disk is also rotatable between a first position, in which a fluidic connection exists between the outlet opening and the first inlet opening via the switching opening in the switching disk, and a second position, in which a fluidic connection exists between the outlet opening and the second inlet opening via the switching opening.

6. The engine system as claimed in claim 1, wherein the switching device comprises an electric motor as an actuation device for switching between switched states.

7. The engine system as claimed in claim 1, further comprising:

a shut-off valve, which is connected between the compressed air outlet of the valve device and the compressor, and which is capable of shutting off or releasing the intake of compressed air from the valve device to the compressor.

8. The engine system as claimed in claim 1, further comprising:

an electronic control device, which is configured for controlling the valve device.

9. A method for controlling an air intake to a compressor of an engine system in a vehicle, the method comprising the acts of:

controlling a valve device such that the valve device is switched between a first switched state, a second switched state, and a third switched state, wherein:

the valve device comprises a valve housing having a first compressed air inlet for connection to an ambient air feed, a second compressed air inlet for connection to a charge air feed, via which precompressed air from a turbocharger is feedable, and a compressed air outlet for connection to the compressor;

the valve device having the first switched state, in which the compressed air outlet is fluidically connected to the first compressed air inlet, and the second switched state, in which the compressed air outlet is fluidically connected to the second compressed air inlet, and wherein the act of controlling the valve device is carried out via a switching device that switches the valve device between the first switched state, the second switched state and to or from the third switched state, in which the first compressed air inlet and the second compressed air inlet are fluidically connected to the compressed air outlet.

10. The method as claimed in claim 9, wherein the valve device is controlled such that it switches between the first and second switched state.

* * * * *